US008245472B2

(12) United States Patent
Keene

(10) Patent No.: US 8,245,472 B2
(45) Date of Patent: Aug. 21, 2012

(54) BUILDING FACADE CONSTRUCTION SYSTEM AND METHODS THEREFOR

(75) Inventor: James Keene, Pepper Pike, OH (US)

(73) Assignee: Keene Building Products Co., Inc., Mayfield Heights, OH (US)

( * ) Notice: Subject to any disclaimer, the term of this patent is extended or adjusted under 35 U.S.C. 154(b) by 416 days.

(21) Appl. No.: 11/410,247

(22) Filed: Apr. 24, 2006

(65) Prior Publication Data

US 2007/0261365 A1 Nov. 15, 2007

(51) Int. Cl.
*E04B 2/00* (2006.01)

(52) U.S. Cl. ..... 52/408; 52/344; 52/454

(58) Field of Classification Search ..... 52/454, 52/344, 388, 408, 267, 315, 741.1; 442/50, 442/54, 52, 381, 386, 390
See application file for complete search history.

(56) References Cited

U.S. PATENT DOCUMENTS 1,434,915 A * 11/1922 Scholfield ..... 52/454
1,799,750 A * 4/1931 Hummert ..... 52/454
2,104,872 A * 1/1938 Levy ..... 52/274
3,435,577 A * 4/1969 O'Leary ..... 52/309.3
3,687,759 A 8/1972 Werner et al.
3,691,004 A 9/1972 Werner et al.
3,729,364 A 4/1973 Doleman et al.
4,211,807 A * 7/1980 Yazawa et al. ..... 428/109
4,212,692 A 7/1980 Rasen et al.
4,558,552 A * 12/1985 Reitter, II ..... 52/745.19
4,617,219 A * 10/1986 Schupack ..... 428/113
4,681,786 A 7/1987 Brown
4,865,259 A 9/1989 Collette
4,879,856 A 11/1989 Jones et al.
5,383,314 A 1/1995 Rothberg
5,489,462 A 2/1996 Sieber
5,596,853 A * 1/1997 Blaney et al. ..... 52/223.7
5,619,832 A 4/1997 Myrvold
5,839,241 A * 11/1998 Cacossa et al. ..... 52/255
6,151,855 A * 11/2000 Campbell ..... 52/408
6,167,668 B1 1/2001 Fine et al.
6,171,984 B1 * 1/2001 Paulson et al. ..... 442/331
6,355,333 B1 * 3/2002 Waggoner et al. ..... 428/174
6,745,531 B1 * 6/2004 Egan ..... 52/302.1
6,804,922 B1 * 10/2004 Egan ..... 52/408
6,901,713 B2 * 6/2005 Axsom ..... 52/481.1

(Continued)

OTHER PUBLICATIONS

Tyvek—Trademark of E. I. DuPont de Nemours and Company Corporation Deleware 1007 Market St. Wilmington Deleware 19898 for construction membrane.

(Continued)

*Primary Examiner* — Jeanette E Chapman
*Assistant Examiner* — James Buckle, Jr.
(74) *Attorney, Agent, or Firm* — Renner, Otto, Boisselle & Sklar, LLP

(57) ABSTRACT

A building façade system adapted to be installed onto an exposed surface of a building and provide a substrate for installation of façade elements (e.g., stone, stucco and the like). The system preferably provides a corrosion-resistant structure adapted to withstand extended environmental exposure. In general, the system includes a highly porous three dimensional matrix filamentous polymeric mat and a fiberglass mesh layer associated therewith. Collectively, the polymeric mat and fiberglass mesh layer are adapted to be installed onto an exposed building wall and provide a substrate onto which desired façade elements may be installed.

6 Claims, 2 Drawing Sheets

U.S. PATENT DOCUMENTS

| | | | | |
|---|---|---|---|---|
| 6,918,218 | B2 * | 7/2005 | Greenway | 52/267 |
| 6,990,775 | B2 * | 1/2006 | Koester | 52/302.1 |
| 7,096,630 | B1 | 8/2006 | Keene et al. | |
| 2002/0170648 | A1 * | 11/2002 | Dinkel | 156/44 |
| 2004/0182028 | A1 * | 9/2004 | Belleau | 52/344 |
| 2005/0144901 | A1 * | 7/2005 | Egan et al. | 52/782.1 |
| 2006/0230699 | A1 | 10/2006 | Keene | |
| 2007/0261365 | A1 * | 11/2007 | Keene | 52/796.1 |

OTHER PUBLICATIONS

Flamestop—Trademark of Lydall, Inc. Corporation Deleware P.O. Box 151 One Colonial Road Manchester Connecticut 06040 for construction membrane.

Harvi-Kraft Trademark of unkown ownership for building paper.

Bitumac—Trademark of unknown ownership for building paper.

* cited by examiner

BUILDING FACADE CONSTRUCTION SYSTEM AND METHODS THEREFOR

FIELD OF THE INVENTION

The present invention relates to a building façade construction system and methods therefor. More specifically, the present invention relates to a corrosion-resistant system and method for creating a robust and durable masonry or similar façade on a building.

BRIEF DISCUSSION OF THE RELATED ART

A building façade is an important building element from a number of perspectives. On one hand, the façade protects the structure against environmental elements (e.g., wind, rain, snow, sleet and the like). In another aspect, the façade plays an important aesthetic role in shaping the building's general appearance, through the use of various constructions such as cast-in-place, precast, tilt-up concrete, stucco, stone, masonry and the like.

Conventional façade constructions typically include a wire mesh (so called "chicken wire") disposed between an exposed building wall and the façade material (e.g., stucco, stone, etc.). The wire mesh generally provides a support substrate that interfaces between the façade and the building wall for securely associating the façade with the building wall. However, the conventional approach of wire mesh presents significant complications. In one regard, corrosion is a major underlying cause of deterioration in building façades. As steel corrodes, it rusts (i.e., produces iron oxide) and thereby expands. Such corrosion produces an expansive force that causes the façade material to begin to crack, and thereby gradually deteriorate. The corrosion also deteriorates the substrate supporting the façade, thereby leading to its degradation as well.

A number of factors contribute toward mesh corrosion. First, general environmental exposure, namely moisture and oxygen, penetrate the façade and attack the underlying mesh. Second, the use of dissimilar metals throughout the façade construction can lead to the creation of a galvanic corrosion cell. Third, various environmental pollutants (e.g., chloride salts, carbon dioxide, acid rain, sulfur dioxide, and the like) can also contribute to corroding the mesh.

The complications of conventional façade construction can lead to inadvertent accident and/or injury. For example, it was observed by Clayford T. Grimm in the 2000 issue of *The Construction Specifier* periodical that masonry falls off a building façade somewhere in the United States about every three weeks. It was additionally observed that forty nine occurrences of such façade failures have injured eighty one individuals and lead to the death of another thirty people. The façade failures are presumably due, at least in part, to corrosion-based deterioration of the façades. Accordingly, there exists a need for an improved system for construction of a building façade.

BRIEF SUMMARY OF THE INVENTION

In accordance with one example aspect, the present invention is directed to a building façade system adapted to be installed onto an exposed surface of a building and provide a substrate for installation of façade elements. The façade system generally includes a highly porous three dimensional matrix filamentous polymeric mat having a first face and a second face, and wherein the first face is adapted to be disposed adjacent a building exposed surface; and a fiberglass mesh layer having a first face and a second face, wherein the fiberglass mesh layer first face is associated with the polymeric mat second face, and wherein the fiberglass mesh layer second face is adapted to provide a substrate for installation of façade elements.

In accordance with another example aspect, the present invention is directed to a corrosion resistant building façade construction. The construction generally includes an exposed surface of a building; a highly porous three dimensional matrix filamentous polymeric mat having a first face and a second face, and wherein the first face is disposed adjacent the building exposed surface; a fiberglass mesh layer having a first face and a second face, and wherein the fiberglass mesh layer first face is disposed adjacent the polymeric mat second face; and façade elements disposed adjacent the fiberglass mesh layer second face.

In accordance with yet another example aspect, the present invention is directed to a building façade system adapted to be installed onto an exposed surface of a building and provide a substrate for installation of façade elements. The faced system generally includes a highly porous three dimensional matrix filamentous polymeric mat having a first face and a second face, and wherein the first face is adapted to be disposed adjacent a building exposed surface; and a fiberglass mesh layer having a first face and a second face, wherein the fiberglass mesh layer first face is heat bonded to the polymeric mat second face, and wherein the fiberglass mesh layer second face is adapted to provide a substrate for installation of façade elements.

BRIEF DESCRIPTION OF THE DRAWINGS

These and other features and a more thorough understanding of the present invention may be achieved by referring to the following description and claims, taken in conjunction with the accompanying drawings, wherein:

DETAILED DISCUSSION OF EXAMPLE EMBODIMENTS

The present invention is directed to a building façade construction system and methods therefor. More specifically and as will be more fully explained hereinafter, the building façade construction system of the present invention provides a novel approach for constructing a building façade that suitably overcomes conventional limitations by reducing the potential for corrosion-based deterioration. As will be more fully explained, the building façade system suitably reduces the potential for corrosion-based deterioration through use of corrosion-resistant materials.

Figure 1:
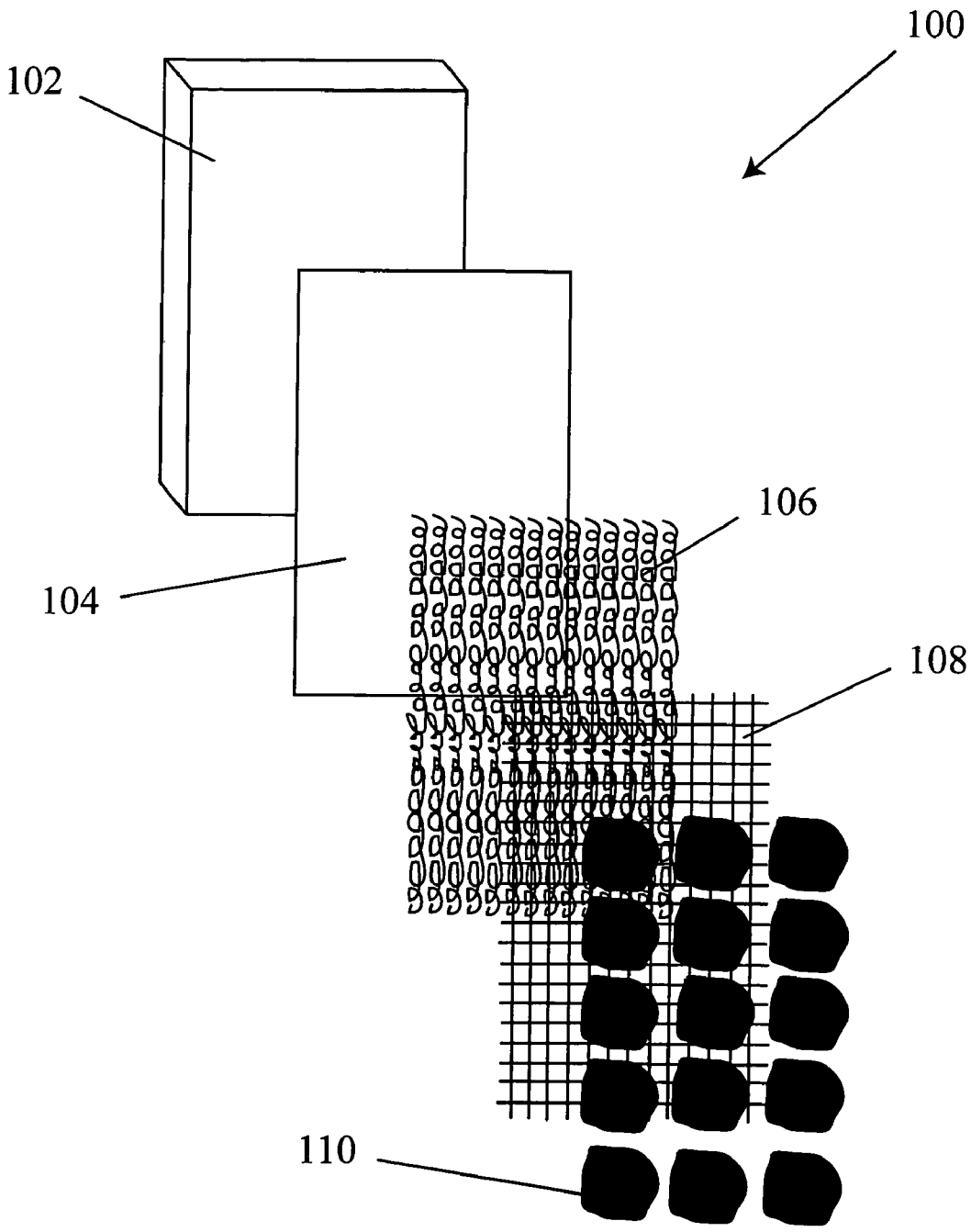
FIG. 1 is an exploded perspective view of an example building façade construction system, according to the present invention.
Figure 2:
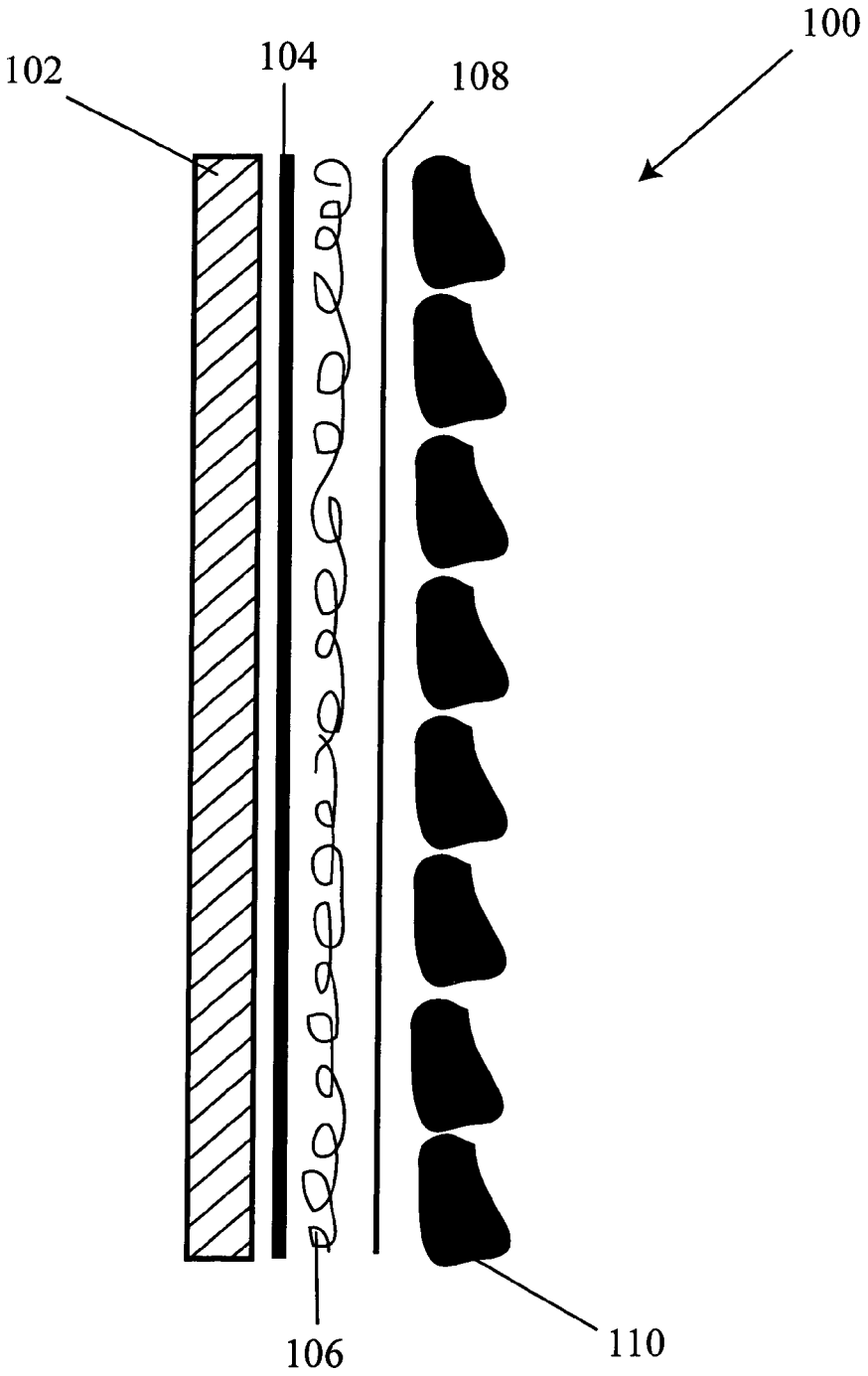
FIG. 2 is a side and partially exploded view of the example building façade construction system of FIG. 1.

FIGS. 1 and 2 illustrate a preferred building façade construction system 100 according to the present invention. The system 100 is generally defined by a plurality of elements that interassociate to define a building façade. More preferably, the system 100 is defined, in order, by a building wall 102, a polymeric mat 106, a mesh layer 108, and a façade layer 110. The system 100 building wall 102 is preferably provided as any exposed wall of a nascent building construction for which a façade is desired, and may suitably be OSB (oriented strand board), plywood, and the like, as known to one of ordinary skill in the art.

The façade system 100 suitably also includes the polymeric mat 106, preferably disposed adjacent an exterior face of the building wall 102. The polymeric mat 106 is preferably provided as a highly porous three dimensional matrix filamentous mat manufactured from a thermoplastic material, such as a polyolefin (e.g., polyethylene, polypropylene, etc.), a polyvinyl halide (e.g., polyvinyl chloride, polyvinylidene chloride, polyvinyltetrafluoride, polyvinyl chlorotrifluoride), polystyrene, polyamide, a polyvinylester (e.g., polyvinyl acetate, etc.), and mixtures, copolymers and modifications thereof. The preferred mat 106 includes a plurality of filaments that are heat fused to one another at randomly spaced points to form a three-dimensional, convoluted and mutually interconnected filamentatious body and is preferably constructed in accordance with techniques well known to one of ordinary skill in the art, such as disclosed by, for example, U.S. Pat. Nos. 3,687,759; 3,691,004; 4,212,692, etc., the contents of all of which are hereby incorporated by reference in their entireties.

It is to be appreciated from the foregoing that the polymeric mat 106, because of its materials, is resistant to water, mold and other environmental factors, thereby eliminating the potential for corrosion observed in conventional wire mesh approaches. It is also to be appreciated that the materials used for manufacture of the polymeric mat 106 may be optimized to increase the mat 106's resistance to other elements, such as microorganisms, UV radiation, and the like. Accordingly, the mat 106 of the present invention ensures that a façade constructed therefrom will maintain its structural integrity and rigidity for significantly extended periods of time, especially relative to conventional wire mesh approaches, thereby reducing maintenance of the façade and the likelihood of accidental damage resulting from a faulty façade.

The polymeric mat 106 may be provided in any thickness suitable to the application of the system 100. For example, the mat 106 may suitably be provided in any of the following non-exhaustive list of thicknesses: approximately ⅛ inch, ¼ inch, ⅓ inch, ½ inch, ⅔ inch, ¾ inch, 1 inch, or any other appropriate size, Metric or English, given the particular configuration and requirements of a building assembly.

Any suitable means may be employed for associating the polymeric mat 106 with the building wall 102. Alternatively, the polymeric mat 106 and the building wall 102 may suitably be interrupted by presence of a building paper 104. As known, building paper 104, such as those commercially available under the tradenames of Tyvek, Flamestop, Harvi-Kraft, Bitumac, and the like, is often disposed about an exposed wall (such as building wall 102) for protection of the same, particularly against moisture. Accordingly, the system 100 of the present invention may suitably include the building paper 104 first disposed adjacent to the exterior face of the building wall 102, and the polymeric mat 106 disposed adjacent to the building paper 104, substantially as shown in FIG. 2. The building paper 104, if optionally present, may suitably be associated with the building wall 102 through any suitable fastener, such as conventional staples. Additionally, the polymeric mat 106 may also be associated with the building paper 104 and/or building wall 102 through any appropriate means, such as a glue-like adhesive, a mechanical fastener (e.g., screw, staple, rivet, mortar, and the like), pressure sensitive tape, and the like.

The system 100 of the present invention suitably also includes the mesh layer 108 disposed about and/or adjacent the polymeric mat 106. In connection with a preferred embodiment, the mesh layer 108 is preferably constructed of fiberglass or a similar material, even more preferably a material displaying resistance to environmental exposure (e.g., alkaline conditions, and the like). Even more preferably, the mesh layer 108 is provided as an amalgam of a plurality of fiberglass strands interassociated in a matrix-like manner (i.e., the mesh layer 108 preferably includes a first plurality of fiberglass strands, each of which is maintained spaced apart and generally parallel relative to each other, and a second plurality of strands, each of which is also maintained spaced apart and generally parallel relative to each other, but with the first plurality of strands and the second plurality of strands being disposed generally perpendicular relative to each other).

The mesh layer 108 is preferably disposed along a face of the polymeric mat 106 that is oriented in generally opposite the building wall 102, thereby generally disposing the polymeric mat 106 between the building wall 102 and the mesh layer 108. Further, the mesh layer 108 is preferably associated with one or more of the polymeric mat 106, the building paper 104, and the building wall 102, through any appropriate means such as a mechanical fastener (e.g., a staple, etc.), heat bonding, and the like.

As will be more fully described hereinafter, the mesh layer 108, either alone or in various combination with the polymeric mat 106, suitably provides a substrate against which the façade layer 110 is secured. Thus, it is to be appreciated that polymeric mat 106 and/or the mesh layer 108, either each alone, or in combination, suitably provide an apparatus that is adapted to replace conventional wire mesh used to secure a façade layer 110, and overcome limitations associated therewith.

The mesh layer 108 and the polymeric mat 106 may suitably be provided as separate elements, or may be provided as associated elements. For example and as previously mentioned, the mesh layer 108 may suitably be heat bonded to the polymeric mat 106, thereby disposing the mat 106 and layer 108 as a generally unitary structure movable, positionable and installable as a single unit. Thus in operation, the mesh layer 108 and polymeric mat 106 may suitably be provided to a construction site as a single unit, and optionally in a rolled form for easy transport of lengths of material. Further, the unit is then cut to required dimensions and then installed on the building wall 102.

With further reference to the preferred unitary structure embodiment, the exemplary unitary structure of the mesh layer 108 and polymeric mat 106 may suitably also include the building paper 104 associated therewith. More specifically, the system 100 of the present invention may suitably be defined by a unitary, generally layered structure having first the building paper 104, second the polymeric mat 106 and then the mesh layer 108, all interassociated into a unit movable and installable as a single structure.

Continuing with the building façade construction system 100, the system 100 preferably also includes the façade layer 110 which generally completes the exterior of the building construction and provides a desired aesthetic appearance. The façade layer 110, regardless of the composition thereof, is preferably disposed along a face of the mesh layer 108 that is oriented generally opposite the building wall 102 (i.e., the façade layer 110 preferably defines an outermost component of the façade system 100 of the present invention).

The façade layer 110 may be provided as any desired façade. For example, the façade layer 110 may consist of a plurality of stones, as generally depicted in FIGS. 1 and 2. Alternatively, the façade layer 110 may suitably consist of stucco, various concrete and/or mortar constructions, or any other suitable façade material.

The façade layer 110 may be associated with one or more of the mesh layer 108, the polymeric mat 106, the building paper 104, and the building wall 102 through any appropriate means. For example, the façade layer 110, especially if provided as a stucco or similar material, may be directly applied to the system 100, with the layer 110 generally impregnating the mesh layer 108 and/or polymeric mat 106 as it is applied. By way of additional example, the façade layer 110, especially if provided as a plurality of stones, may be associated with the system 100 through mortar or similar material.

As will be appreciated from the foregoing discussion, the façade system 100 of the present invention suitably provides advantages relative to convention façade construction approaches. In one aspect, the system 100 provides for moisture drainage without compromising the structural integrity of the system 100 (e.g., without being subject to conventional corrosion). As previously mentioned, the polymeric mat 106 and mesh layer 108 are highly porous. Accordingly, their disposition as a component of a building façade provides a continuous conduit through which water and other moisture may suitably drain. The conventional use of wire mesh may result in a tightly and densely compacted building façade that traps water and is prone to moisture-based degradation (e.g., corrosion, warping, etc.). The mat 106 and mesh layer 108 of the present invention suitably display a degree of structural resilience that resist such compacting, thereby preserving a porosity that permits drainage. The structural rigidity of the mat 106 and mesh layer 108 suitably also provide a structure capable of supporting a façade for an extended period of time.

In another advantage, the façade system 100 of the present invention simplifies façade construction and/or installation. As previously mentioned, the system 100 may include a unitary structure defined by one or more of the building paper 104, the polymeric mat 106, and the mesh layer 108. This unitary structure may suitably be directly associated with and/or installed on the building wall 102, and then modified to feature any desired façade layer 110. Relative to conventional approaches, the approach façade system 100 of the present invention reduces the time and complexity involved with construction of a façade.

In yet another advantage, the façade system 100 reduces the likelihood of injury associated with constructing a façade. Conventional wire mesh systems exposure installers to potential injury from accidental exposure and/or contact with exposed wire ends and other generally sharp prominences. The façade system 100 of the present invention is preferably manufactured from polymeric materials that significantly reduce the likelihood of injury resulting from physical contact.

In a further advantage, the polymeric mat 106 provides sound control benefits. The polymeric mat 106, because of its three dimensional matrix configuration and the material employed for manufacture thereof, displays sound absorption characteristics. Accordingly, the presence of the polymeric mat 106 as a component of a building façade may suitably decrease the extent of external noise penetrating into the space behind the building façade.

Although the invention has been described with regard to certain preferred example embodiments, it is to be understood that the present disclosure has been made by way of example only, and that improvements, changes and modifications in the details of construction and the combination and arrangement of parts may be resorted to without departing from the spirit and scope of the invention. Such improvements, changes and modifications within the skill of the art are intended to be covered by the scope of the appended claims.

What is claimed is:

1. A building facade construction comprising:

a surface of a building wall;

a porous three dimensional matrix filamentous polymeric mat having a first face and a second face, the polymeric mat being manufactured from a thermoplastic polymer wherein the polymeric mat comprises a plurality of filaments that are heat fused to one another at randomly spaced points to form a three-dimensional body, and wherein the first face contacts the building surface or a building paper layer overlying the building surface;

a fiberglass mesh layer comprising a first plurality of fiberglass filaments disposed in a spaced apart and parallel relationship to each other, and a second plurality of fiberglass filaments disposed in a spaced apart and parallel relationship to each other, and wherein the first plurality of filaments is bonded to the second plurality of filaments in a substantially perpendicular orientation, the fiberglass mesh layer having a first face and a second face wherein the first face of said fiberglass mesh layer is bonded to the polymeric mat second face, wherein the polymeric mat and the fiberglass mesh layer are bonded together to form a unitary structure prior to being installed on the surface of the building, the unitary structure being movable, positionable and installable as a single unit and being suitable for being provided in rolled form for ease of transport; and a building facade layer comprising one or more components, at least one of the components impregnating the fiberglass mesh layer, the building facade layer being supported by the fiberglass mesh layer in combination with the polymeric mat;

the unitary structure comprising a continuous conduit for water drainage.

2. The building facade construction of claim 1 wherein the polymeric mat is manufactured from a thermoplastic material selected from the group consisting of a polyolefin, a polyvinyl halide, a polyamide, and a polyvinyl ester.

3. The building facade construction of claim 1, wherein the fiberglass mesh layer is alkali resistant.

4. The building facade construction of claim 2, wherein the polymeric mat comprises a plurality of filaments that are connected to one another at randomly spaced points to form a three dimensional, convoluted filament body.

5. The building facade construction of claim 1, wherein the fiberglass mesh layer is heat bonded to the polymeric mat.

6. The building facade construction of claim 1 further comprising a moisture resistant building paper layer located between the first face of the polymeric mat and the building surface.

* * * * *